United States Patent [19]

Roberts

[11] 4,344,379

[45] Aug. 17, 1982

[54] BONDING MACHINE AND GRAVURE APPLICATOR ROLL

[75] Inventor: Webster C. Roberts, Cherry Hill, N.J.

[73] Assignee: Molins Machine Company, Inc., Cherry Hill, N.J.

[21] Appl. No.: 230,770

[22] Filed: Feb. 2, 1981

[51] Int. Cl.[3] ..... B05C 1/08

[52] U.S. Cl. ..... 118/44; 118/212; 118/221; 118/249; 118/261; 29/121.5

[58] Field of Search ..... 29/121.5, 121.6; 118/212, 44, 249, 261, 221; 101/157, 170; 156/470

[56] References Cited

U.S. PATENT DOCUMENTS

| | | | |
|---|---|---|---|
| 494,271 | 3/1893 | Dodd | 29/121.5 |
| 1,135,509 | 4/1915 | Ferres . | |
| 1,609,318 | 9/1923 | Smith . | |
| 2,051,319 | 4/1935 | Sieg . | |
| 2,116,289 | 5/1938 | Shepherd | 29/121.5 X |
| 2,531,036 | 7/1946 | Goettsch . | |
| 2,677,971 | 1/1953 | Greenwood . | |
| 3,300,359 | 1/1967 | Nikkel | 118/212 X |
| 3,994,768 | 11/1976 | Roberts | 118/203 X |

*Primary Examiner*—John P. McIntosh

*Attorney, Agent, or Firm*—Seidel, Gonda, Goldhammer & Panitch

[57] ABSTRACT

The applicator roll of a single facer or a double facer glue machine has successive patterns with each pattern having different size cells from which a bonding agent may be transferred to the crests of corrugated paper. The applicator roll can be independently adjusted to change the phase of the cells relative to the crests of the corrugated paper to vary the amount of bonding agent transferred to the crests.

12 Claims, 9 Drawing Figures

FIG. 1
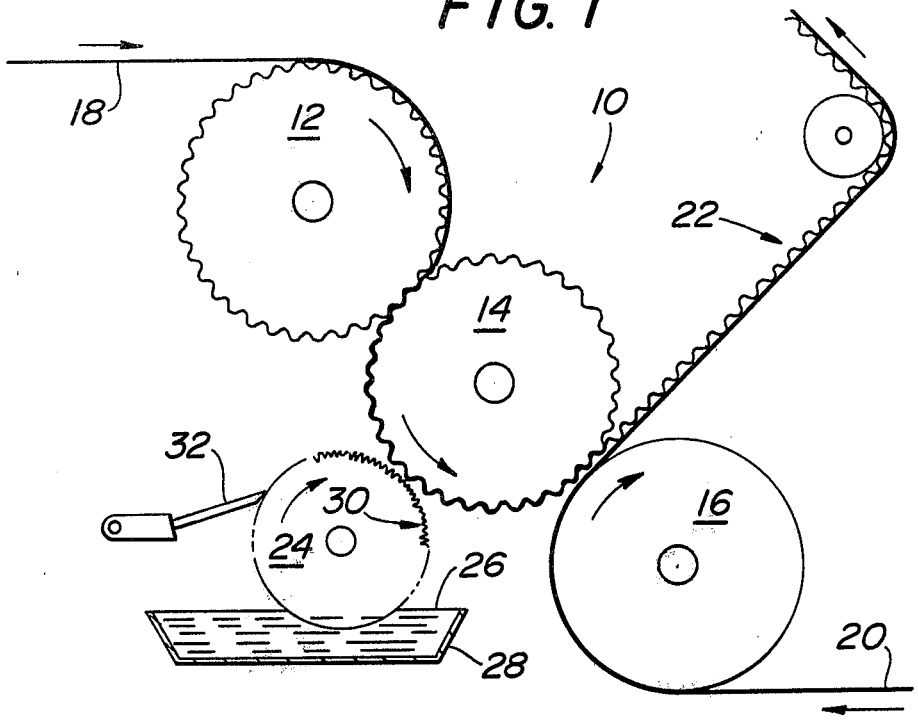
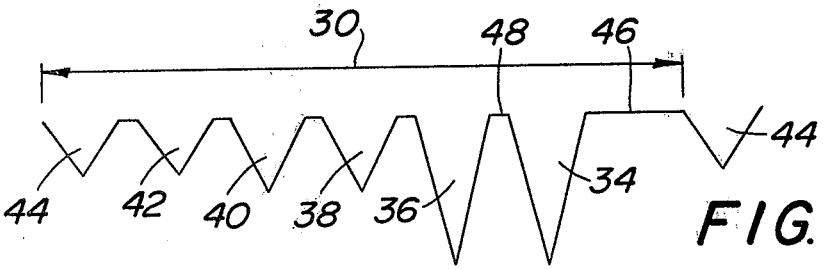
FIG. 2
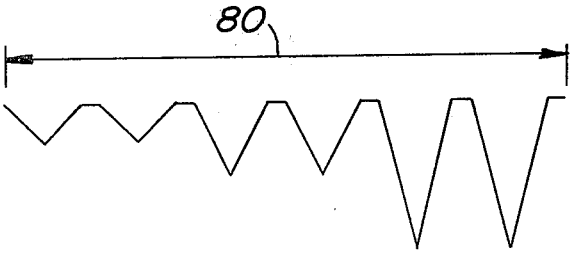
FIG. 3
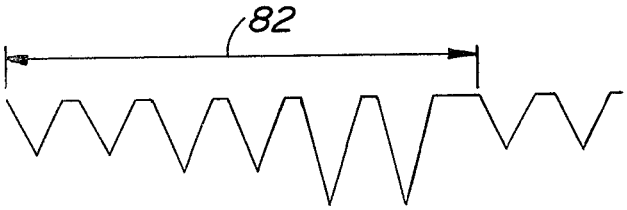
FIG. 4

FIG. 8
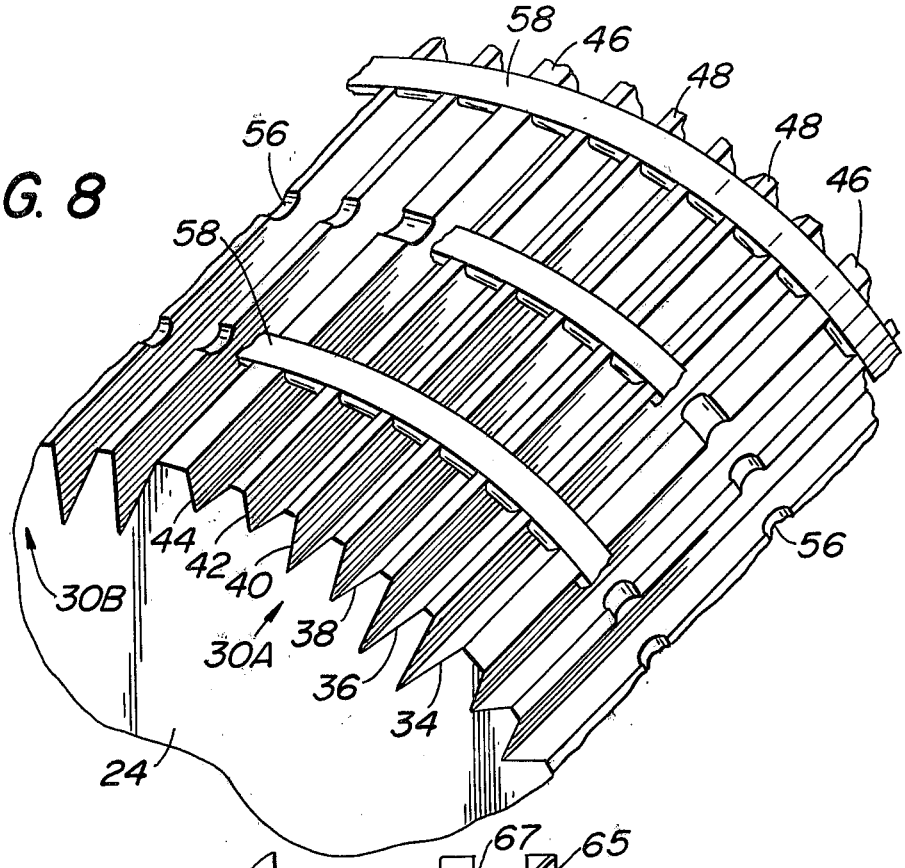
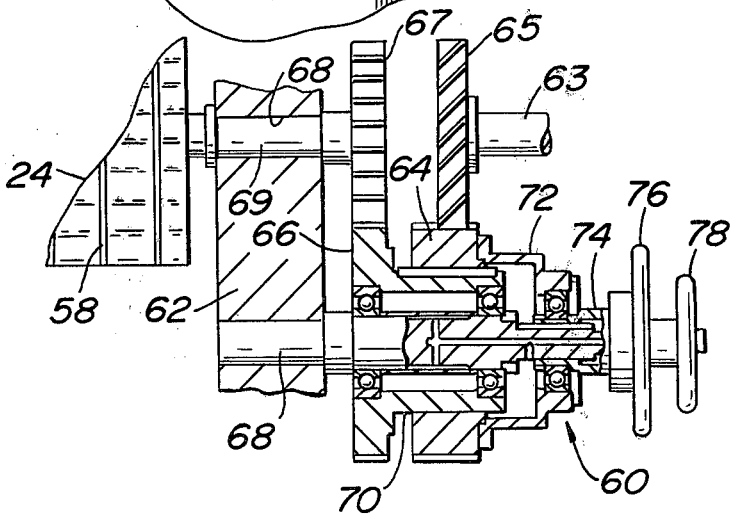
FIG. 9

BONDING MACHINE AND GRAVURE APPLICATOR ROLL

BACKGROUND

The present invention pertains to the manufacture of corrugated paper board, and more specifically, to the application of a liquid bonding agent to the web of corrugated paper board prior to combining the web to a liner in a single facer machine or a double facer glue machine.

In a conventional single facer machine, a web of medium is corrugated as it passes between a pair of meshed fluted rolls. The corrugated web of medium is thereafter brought in contact with the surface of an adhesive applicator roll. The adhesive applicator roll usually has a lower surface speed than that of the corrugated medium and as a result thereof adhesive is transferred to the crests by a wiping action. The thusly processed medium is then bonded to a web of liner board by pressure from a pressure roll.

The usual practice has been to utilize an adhesive applicator roll having a roughened surface to retain a thin film of adhesive. The thickness of the film was governed by the gap between the adhesive applicator roll and a doctor roll or wiper blade. The amount of adhesive applied was also affected by changing the speed of the applicator roll relative to machine speed. This was known as the taper speed adhesive roll drive. Its principal objection was the application of a greater amount of adhesive at slow than at high speeds, thereby wasting adhesive at slow speeds. Many attempts were made to overcome this disadvantage. One of the principal alternatives was the application of adhesive in stripes on the liner in a pattern corresponding to the flute pitch. Representative of prior art patents on that alternative are U.S. Pat. Nos. 1,135,509; 1,609,318; 2,051,319; and 2,531,036.

Other attempts were directed to an adhesive applicator roll having a gravure or cell-embossed surface. The cells were intended to hold a predetermined quantity of adhesive so that only a uniform amount of adhesive would be applied to the flute crests. This type of roll was generally rotated at the same surface speed as the corrugated medium so that only the adhesive from a single row of cells would contact the flute crests.

While the procedures outlined above have been followed for many years, there are still disadvantages and objections. In addition to the wastage of adhesive by the application of a surplusage which wastes heat for drying and gelling, there is no way to apply a predetermined amount of adhesive and at the same time vary the amount applied to suit the characteristic of the paperboard being produced. The adhesives in general use an emulsion of starch, water and various alkalis to modify the gellatinization temperature. Some adhesives employ a gelled starch carrier containing various amounts of raw starch. Starch is an organic chemical and exhibits different characteristics depending upon the refining method whether made from corn, potato, or tapioca and the amount of associated water.

Corrugating mediums vary in their degree of hydroscopicity. Liners on the other hand are comparatively dense and do not readily absorb liquid adhesive. These variables have provided a need in the industry for means to vary the amount of adhesive applied to the flute tips while applying only a predetermined amount. There is also a need for the solution of this problem in the specific environment of corrugators which use cold-setting adhesives or bonding agents whereby the corrugator will be energy saving.

SUMMARY OF THE INVENTION

The present invention is directed to an applicator roll for applying a liquid bonding agent to the crests of a web of corrugated paper. The present invention is also directed to a machine which includes such applicator roll. Such applicator roll may be an integral part of a new machine or may be substituted for presently existing applicator rolls.

The applicator roll of the present invention comprises a cylinder having a journal at each end for rotatably supporting the same. The surface of the cylinder is provided with successive circumferential patterns of different size cells. Each circumferential cell pattern comprises rows of cells having progressively greater volume, while the cells in each axial row are of substantially constant volume. Preferably, each pattern consists of pairs of rows in which the cells in each pair have the same volume and each successive circumferential pair have progressively greater volume.

A single facer machine or double facer glue machine in accordance with the present invention includes the above-mentioned applicator roll and driven in synchronization with corrugated paper. A means is provided for independently rotating the applicator roll to change the phase of the cells of a pattern relative to the crests of corrugated paper to vary the amount of bonding agent transferred to the crests.

It is an object of the present invention to provide means for quickly varying the amount of bonding agent applied to flute tips.

It is a further object of this invention to provide means for applying a preselected amount of bonding agent to flute tips.

It is another object of the present invention to provide a facer machine suitable for use with cold-setting bonding agents for producing A-flute, B-flute or C-flute corrugated paperboard.

Other objects will and advantages will appear hereinafter.

For the purpose of illustrating the invention, there is provided in the drawings a form which is presently preferred; it being understood, however, that this invention is not limited to the precise arrangements and instrumentalities shown.

FIG. 1 is a diagramatic view of the major operative components of a single facer machine.

FIG. 2 is a flat elevation view of a gravure pattern for use in connection with A-flute paperboard.

FIG. 3 is a view similar to FIG. 2 but for use with C-flute paperboard.

FIG. 4 is a view similar to FIG. 2 but for use with B-flute paperboard.

FIG. 8 is a partial perspective view of a portion of the applicator roll.

FIG. 9 is a sectional view of means for adjusting the phase of the applicator roll relative to the corrugating roll.

DETAILED DESCRIPTION

Figure 5:
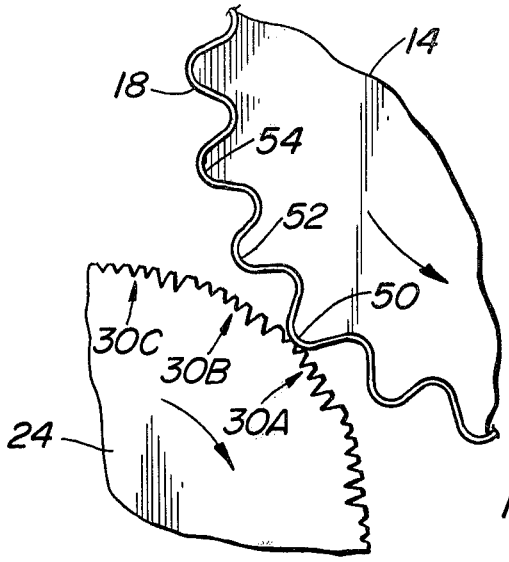
FIGS. 5–7 are progressive illustrations of the interrelationship between a portion of the corrugating roll and a portion of the applicator roll.

Referring to the drawing in detail, wherein like numerals indicate like elements, there is shown in FIG. 1 the major operative components of a single facer machine 10. An upper corrugating roll 12 has flutes in mesh with flutes on a lower corrugating roll 14. The use of a heating or cooling medium in roll 14 is optional depending on the type of bonding agent to be used. A pressure roll 16 is juxtaposed to the corrugating roll 14 and on the opposite side thereof from the corrugating roll 12. A web of medium 18 is corrugated by being passed between the rolls 12 and 14. Adhesive is applied to the crests of the medium 18 while the latter is on the corrugating roll 14. A liner 20 passes around a pressure roll 16 and is bonded to the crests of the medium 18 to thereby form a web 22 of single faced paperboard.

An applicator roll 24 is driven in synchronization with the corrugating roll 14 in a conventional manner. Applicator roll 24 applies a bonding agent 26 from the pan 28 to the crests of the corrugated medium 18. The bonding agent 26 is preferably a cold-setting adhesive bonding agent, the details of which are known to those skilled in the art. A wiper blade 32 or its equivalent is associated with the applicator roll 24 for maintaining the surface of the applicator roll 24 free from excessive bonding agent 26.

The applicator roll 24 is provided on its periphery with a plurality of successive patterns 30 of different size cells. In FIG. 2 there is shown a flat representative of a typical pattern 30 for use in connection with making A-flute paperboard. Pattern 30 includes grooves defining a first pair of rows 34, 36 of cells, a second pair of rows 38, 40 of cells, and a third pair of rows 42, 44 of cells. The volume of the rows of cells are of decreasing amount in the sequence described. The preferred volume of the cells of rows 34, 36 is twice that of rows 38, 40 and triple that of rows 42, 44. A typical pattern 30 matches the pitch of flutes on roll 14 and has a length of 0.344 inches which includes the cells, the land 46 between adjacent patterns, and the lands 48 between adjacent rows. Lands 38 may have a width of 0.01 inches while land 46 may have a width of 0.050 inches. Typical dimensions for the depth of the rows of pattern 30 are: rows 34, 36 have depth of 0.08 inches, rows 38, 40 have a depth of 0.04 inches, and rows 42, 40 have a depth of 0.03 inches.

Figure 6:
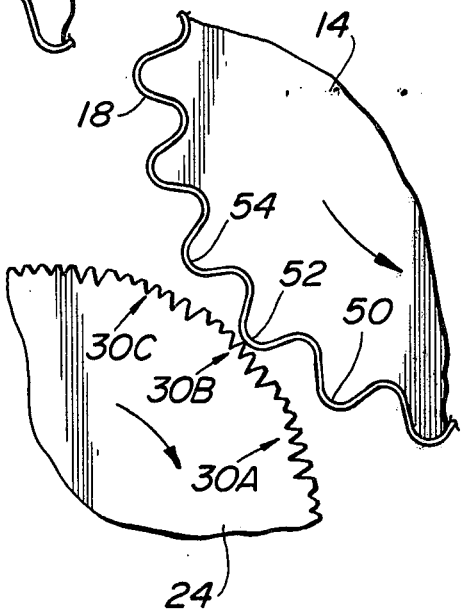
Figure 7:
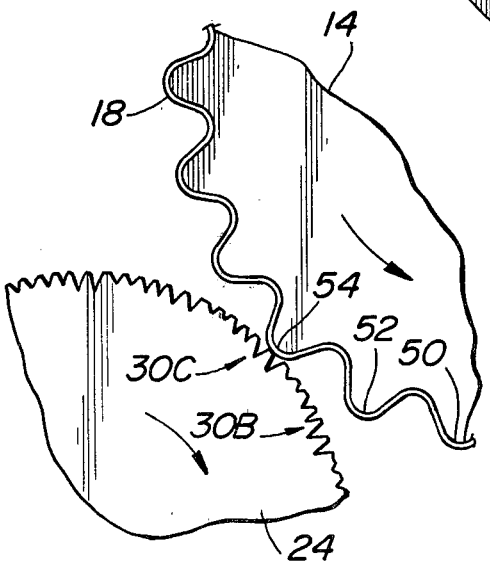

In FIG. 5, the successive patterns 30 are designated 30A, 30B and 30C. Individual flutes of the roll 14 are designated 50, 52 and 54. As the rolls 14 and 24 rotate in opposite directions as indicated by the arrows in FIG. 5, it will be seen that the crest of the medium 18 on flute 50 will contact only a portion of the pattern 30A, the crest of the medium 18 on flute 52 will contact a corresponding portion of the pattern 30B, etc. Each crest of the corrugated medium 18 will contact the same portion of the patterns. As shown in FIG. 5, the portion of the pattern 30 which is contacted is the rows 42, 44. In FIG. 6 the phase of the pattern has been adjusted so that the crest of medium 18 on flute 52 contacts rows 38, 40. Likewise in FIG. 7 the crest of medium 18 on flute 54 contacts rows 34, 36. The manner in which said phase change is accomplished will be described hereinafter.

As shown in FIG. 8, the rows of each pattern 30 are preferably delineated into aligned discrete cells. In this regard, a helical groove 56 is applied to the lands 46, 48. Thereafter, a filler 58 is applied to fill the groove 56. The outer surface of the filler is flush with the lands 46, 48 to thereby provide a contact surface which is cylindrical and against which the wiper blade can be brought to bear. Hence, there will be less wear, vibration and noise due to contact between the applicator roll 24 and its wiper blade 32 or equivalent. Filler 58 is preferably a metal wire made from a material such as stainless steel, bronze, etc. A suitable helical pitch for the filler 58 is 0.080 inches when using a filler wire having 0.020 inches in diameter. Filler 58 is fixedly secured to the roll 24 in any convenient manner such as by brazing.

The applicator roll 24 and the corrugating roll 14 are driven in synchronization in a conventional manner. A means is provided for independently rotating the applicator roll 24 relative to the corrugating roll 14 so as to change the portion of the pattern 30 which will be juxtaposed to the crest of a predetermined flute on roll 14. Such means is shown in FIG. 9 and is similar to that disclosed in U.S. Pat. No. 2,051,319 wherein the applicator roll applies stripes of adhesive directly to the flat liner.

The adjusting means 60 is disposed on one side of the frame wall 62. Means 60 is supported by stud shaft 68. Drive shaft 63 is driven by gearing, not shown, from corrugating roll 14. Helical gear 65 connected to drive shaft 63 drives helical gear 64. Gear 64 is movable axially to cause rotation of roll 24 relative to roll 14. A gear 66 is loosely mounted on fixed stud shaft 68 through suitable bearings and is driven by gear 64. The gear 66 is also provided with a sleeve portion 70 upon which the helical gear 64 is splined for axial movement therealong. Gear 66 drives gear 67 which is fixed to a journal 69 of applicator roll 24.

For moving the helical gear 66, there is provided a sleeve 72 having a flanged portion at one end secured to the gear 64 and connected adjacent the other end to a thrust sleeve 74 by means of a thrust bearing. The thrust sleeve 74 is splined to the shaft 68 so as to be axially movable therealong. The outer end of the thrust sleeve 74 is connected to a handwheel 76 threaded on the stud shaft 68 and having a flange at one end extending into a groove formed on the thrust sleeve 70 whereby the handwheel is rotatable with respect to the thrust sleeve 70 and is movable therewith in an axial direction.

When the handwheel 76 is turned, it is moved axially on the threaded stud shaft 70, carrying with it the helical gear 64. Helical gear 64 is substantially longer than its mating gear associated with shaft 14 so as to permit a substantial relative axial movement without interfering with the mesh of the gears. This axial movement of gear 64 causes it to advance or retard with respect to its mating helical gear and thereby provide for a desired circumferential adjustment of the applicator roll 24 with respect to the corrugating roll 14.

Since the vibration of the machine and the end thrusts of the helical gears are apt to accidently turn the handwheel 76, there is provided a locking handwheel 78. Handwheel 78 has a hub portion threaded onto the shaft 68 and adapted to abut the hub of the handwheel 76 so as to jam the latter wheel in a locked position.

In conventional corrugators, there are three sizes of flutes that may be provided: A-flute having 35 flutes to the foot; B-flute having 47 flutes to the foot; and C-flute having 39 flutes to the foot. The respective flute pitches are 0.344 inch, 0.355 inch and 0.307 inch. In FIG. 3 there is illustrated a pattern 80 comparable to pattern 30 but designed for use with a C-flute. Similarly, in FIG. 4 there is illustrated a comparable pattern 82 for use with a B-flute.

The present invention provides for the selective application of at least two and preferably three different quantities of bonding agent to each flute crest. The preferred minimum volume of bonding agent for single faced board is 0.75 gallons per 1,000 square feet of board. If the cells of pattern 30 are separated by lands 48 which are 0.01 inches wide, and the axial pitch of filler 58 is 0.08 inches with a width or diameter of 0.02 inches, the preferred minimum volume per cell in rows 42, 44 is 0.000032 cubic inches. Thus, rows 42, 44 are 0.02 inches deep and 0.04 inches wide at the surface of the roll 24. Similarly, rows 38, 40 in order to have a volume of 0.000064 cubic inches, should have a depth of 0.04 inches, have a width at the surface of the roll 24 of 0.04 inches, and an axial length of 0.08 inches. Similarly, rows 34, 36 in order to have a volume of 0.000128 cubic inches should be 0.08 inches deep, 0.04 inches wide at the surface of roll 24, and 0.08 inches long. Since complete extraction of bonding agent from the cells rarely occurs, some increase in the volume of the cells may be provided as desired.

Thus, it is preferred that the rows of the patterns be subdivided into cells by the filler 58. That construction causes the adhesive bonding agent to be applied to the tips of the crests of corrugated medium as discrete drops. When the flute tips bearing the drops of adhesive bonding agent are pressed against the liner 20, the drops of bonding agent spread to form a uniform line of bonding agent.

While it is preferred that the cells be defined as described herein, a similar but less effective result can be attained solely by use of the helical groove 56. In that event, a doctor roll must be employed in place of the scraper blade 32 to remove surplus bonding agent from the surface of the applicator roll 24.

By means of the present invention, two, three or more differently sized cell patterns may be utilized for transferring a bonding agent to the tips of the crests in the corrugated medium 18. Adjustment from one portion of a cell pattern to another requires rotation of the handwheel 76 so as to provide a relative adjustment between rolls 14 and 24 in a circumferential direction less than 0.1 inches.

The present invention may be embodied in other specific forms without departing from the spirit or essential attributes thereof and, accordingly, reference should be made to the appended claims, rather than to the foregoing specification, as indicating the scope of the invention.

I claim:

1. A system for applying a selectively variable amount of liquid bonding agent to the crests of a web of corrugated paperboard comprising a frame, a vessel associated with the frame for holding a supply of liquid bonding agent, an applicator roll associated with the vessel for transferring a bonding agent from the vessel to crests of a corrugated medium, the surface of the applicator roll being provided with successive patterns of different size cells, each pattern of cells comprising axially extending rows of cells of different volume, all cells in a row being of substantially equal volume, and means for rotating said applicator roll so as to change the phase of the cells relative to the crests of the corrugated paper to vary the amount of bonding agent transferred to the crests from said cells.

2. A system in accordance with claim 1 wherein the width of each pattern is equal to the distance between the crests of the corrugated medium.

3. A system in accordance with claim 1 wherein the speed of the medium is substantially equal to the surface speed of the applicator roll.

4. A system in accordance with claim 1 wherein said applicator roll has a continuous circumferential surface on a portion of its periphery.

5. Apparatus in accordance with claim 1 wherein the cells of one row of one of said patterns have a depth which is different from the depth of cells in another row of said one pattern.

6. A single facer machine comprising a frame, a pair of meshing fluted rolls for corrugating a web of material fed therebetween, an adhesive applicator roll juxtaposed to one of said fluted rolls for applying a liquid bonding agent to the tips of a corrugated medium supported by said one roll, a vessel for holding a supply of the bonding agent, motor means for rotating said applicator roll and said one of said fluted rolls in synchronized fashion, the improvement comprising the surface of the applicator roll being provided with successive patterns of cells, each pattern of cells including axially extending rows having progressively greater volume, and means for selectively adjusting the phase relationship between said applicator roll and said one fluted roll to vary the amount of bonding agent transferred from said cells to the crests of the corrugated medium.

7. Apparatus in accordance with claim 6 wherein the circumferential width of each pattern is equal to the pitch of the flutes on said fluted rolls.

8. Apparatus in accordance with claim 6 wherein each pattern includes pairs of rows, the cells in one pair of rows being of substantially equal volume.

9. An applicator roll for applying a liquid bonding agent to a web of material such as paper comprising a cylindrical roll having a journal at each end for rotatably supporting the same, the surface of said roll being provided with successive patterns of different sized cells, each pattern comprising axially extending rows of cells, the cells in a row being of substantially constant volume.

10. Apparatus in accordance with claim 9 wherein each pattern includes successive pairs of rows, each row of a pair having the same depth and circumferential width at the periphery of the roll.

11. Apparatus in accordance with claim 9 including a continuous circumferential surface on a portion of the periphery of said roll at spaced locations along the length of said roll.

12. Apparatus in accordance with claim 9 wherein each pattern has three rows of cells each of a different volume.

* * * * *